US008408333B2

(12) United States Patent
Pai et al.

(10) Patent No.: US 8,408,333 B2
(45) Date of Patent: Apr. 2, 2013

(54) STEER SYSTEMS FOR COILED TUBING DRILLING AND METHOD OF USE

(75) Inventors: Satish Pai, Paris (FR); Keith Moriarty, Houston, TX (US); Geoff Downton, Minchinhampton (GB); Warren Zemlak, Moscow (RU); Devin Rock, Katy, TX (US); Jonathan Mattick, Sugar Land, TX (US); Denny Adelung, Bellaire, TX (US)

(73) Assignee: Schlumberger Technology Corporation, Sugar Land, TX (US)

( * ) Notice: Subject to any disclaimer, the term of this patent is extended or adjusted under 35 U.S.C. 154(b) by 180 days.

(21) Appl. No.: 11/740,335

(22) Filed: Apr. 26, 2007

(65) Prior Publication Data

US 2007/0261887 A1 Nov. 15, 2007

Related U.S. Application Data

(60) Provisional application No. 60/747,074, filed on May 11, 2006.

(51) Int. Cl.
*E21B 7/04* (2006.01)
*E21B 7/08* (2006.01)

(52) U.S. Cl. ..... 175/61; 175/73; 175/107; 175/45

(58) Field of Classification Search ..... 175/61, 175/73, 107, 45
See application file for complete search history.

(56) References Cited

U.S. PATENT DOCUMENTS

| | | | | |
|---|---|---|---|---|
| 4,185,704 | A | 1/1980 | Nixon | |
| 4,463,814 | A | 8/1984 | Horstmeyer | |
| 4,471,843 | A * | 9/1984 | Jones et al. | 175/73 |
| 4,947,944 | A | 8/1990 | Coltman | |
| 5,060,737 | A | 10/1991 | Mohn | |
| 5,139,094 | A | 8/1992 | Prevedel | |
| 5,156,222 | A | 10/1992 | Jurgens | |
| 5,163,521 | A * | 11/1992 | Pustanyk et al. | 175/40 |
| 5,168,941 | A | 12/1992 | Krueger | |
| 5,311,952 | A * | 5/1994 | Eddison et al. | 175/61 |
| 5,318,137 | A | 6/1994 | Johnson | |
| 5,318,138 | A | 6/1994 | Dewey | |
| 5,332,048 | A | 7/1994 | Underwood et al. | |
| 5,394,951 | A | 3/1995 | Pringle | |
| 5,419,405 | A | 5/1995 | Patton | |
| 5,452,772 | A | 9/1995 | Van Den Bergh | |
| 5,485,889 | A * | 1/1996 | Gray | 175/61 |
| 5,603,386 | A | 2/1997 | Webster | |
| 5,812,068 | A | 9/1998 | Wisler | |
| 5,842,149 | A | 11/1998 | Harrell | |

(Continued)

FOREIGN PATENT DOCUMENTS

| | | |
|---|---|---|
| EP | 0787886 A2 | 4/1905 |
| GB | 2398308 A | 4/1946 |

(Continued)

OTHER PUBLICATIONS 25.0397RU—Decision of Grant dated Sep. 23, 2011.

(Continued)

*Primary Examiner* — Cathleen Hutchins

(74) *Attorney, Agent, or Firm* — Chadwick Sullivan

(57) ABSTRACT

A technique provides a drilling system and method in which a drilling assembly is delivered downhole on coiled tubing. The drilling assembly comprises a drill bit and a motor to rotate the drill bit for drilling of a borehole. A steerable system is used to steer the drill bit, thereby enabling formation of deviated boreholes.

19 Claims, 4 Drawing Sheets

U.S. PATENT DOCUMENTS

| | | | | |
|---|---|---|---|---|
| 6,047,784 | A | 4/2000 | Dorel | |
| 6,092,610 | A | 7/2000 | Kosmala | |
| 6,206,108 | B1 * | 3/2001 | MacDonald et al. | 175/24 |
| 6,244,361 | B1 | 6/2001 | Comeau | |
| 6,446,737 | B1 | 9/2002 | Fontana et al. | |
| 7,028,789 | B2 | 4/2006 | Krueger | |
| 2003/0075361 | A1 * | 4/2003 | Terry et al. | 175/61 |
| 2003/0127252 | A1 * | 7/2003 | Downton et al. | 175/73 |
| 2004/0050589 | A1 * | 3/2004 | Head | 175/57 |
| 2005/0056463 | A1 * | 3/2005 | Aronstam et al. | 175/61 |

FOREIGN PATENT DOCUMENTS

| | | | |
|---|---|---|---|
| RU | 2105880 | C1 | 2/1998 |
| RU | 2148696 | C1 | 5/2000 |
| RU | 2148696 | C1 | 6/2000 |
| WO | 00/57018 | | 9/2000 |

OTHER PUBLICATIONS 25.0397MX—Office Action dated Nov. 7, 2011.

* cited by examiner

STEER SYSTEMS FOR COILED TUBING DRILLING AND METHOD OF USE

CROSS-REFERENCE TO RELATED APPLICATION

The present document is based on and claims priority to U.S. Provisional Application Ser. No. 60/747,074, filed May 11, 2006.

BACKGROUND

The invention relates generally to methods and systems for the directional drilling of wells, particularly wells for the production of petroleum products. More specifically, it relates to steerable systems run on coiled tubing.

It is known that when drilling oil and gas wells for the exploration and production of hydrocarbons, it is often necessary to deviate the well off vertical and in a particular direction. This is called directional drilling. Directional drilling is used for increasing the drainage of a particular well by, for example, forming deviated branch bores from a primary borehole. Also it is useful in the marine environment, wherein a single offshore production platform can reach several hydrocarbon reservoirs, thanks to several deviated wells that spread out in any direction from the production platform.

Directional drilling systems usually fall within two categories: push-the-bit and point-the-bit systems, classified by their mode of operation. Push-the-bit systems operate by applying pressure to the side walls of the formation containing the well. Point-the-bit systems aim the drill bit to the desired direction, thereby causing deviation of the wellbore as the bit drills the well's bottom.

Push-the-bit systems are known and are described, for example, in U.S. Pat. No. 6,206,108 issued to MacDonald et al. on Mar. 27, 2001, and International patent application no. PCT/GB00/00822 published on Sep. 28, 2000 by Weatherford/Lamb, Inc. These references describe steerable drilling systems that have a plurality of adjustable or expandable ribs or pads located around the corresponding tool collar. The drilling direction can be controlled by applying pressure on the well's sidewalls through the selective extension or retraction of the individual ribs or pads.

Point-the-bit systems are usually based on the principle that when two oppositely rotating shafts are united by a joint and form an angle different than zero, the second shaft will not orbit around the central rotational axis of the first shaft, provided the two rates of rotation of both shafts are equal.

Various point-the-bit techniques have been developed which incorporate a method of achieving directional control by offsetting or pointing the bit in the desired direction as the tool rotates. One such point-the-bit technique is outlined in U.S. Pat. No. 6,092,610 issued to Kosmala et al. on Jul. 25, 2000, the entire contents of which are hereby incorporated by reference. This patent describes an actively controlled rotary steerable drilling system for directional drilling of wells having a tool collar rotated by a drill string during well drilling. The bit shaft is supported by a universal joint within the collar and rotatably driven by the collar. To achieve controlled steering of the rotating drill bit, orientation of the bit shaft relative to the tool collar is sensed and the bit shaft is maintained geostationary and selectively axially inclined relative to the tool collar. This position is maintained during drill string rotation by rotating it about the universal joint via an offsetting mandrel that is rotated counter to collar rotation and at the same frequency of rotation. An electric motor provides rotation to the offsetting mandrel with respect to the tool collar and is servo-controlled by signal input from position sensing elements. When necessary, a brake is used to maintain the offsetting mandrel and the bit shaft axis geostationary. Alternatively, a turbine is connected to the offsetting mandrel to provide rotation to the offsetting mandrel with respect to the tool collar and a brake is used to servo-control the turbine by signal input from position sensors.

Current rotary steerable systems are run on drill string and thus inherit the operational limitations associated with the drill string. An attempt has been made to combine a rotary steerable system with coiled tubing as described in U.S. Pat. No. 7,028,789. This reference discloses an integrated motor and steering system for coiled tubing drilling. However, as will be discussed below, the apparatus described in the U.S. Pat. No. 7,028,789 has several inherent disadvantages overcome by the teachings of the present invention.

SUMMARY

In general, the present invention provides a drilling system and method in which a drilling assembly is delivered downhole on a coiled tubing. The drilling assembly comprises a drill bit, steerable system and a motor to rotate the steerable system and drill bit for drilling of a borehole. The steerable system is used to steer the drill bit, thereby enabling formation of boreholes in a variety of orientations and trajectories.

BRIEF DESCRIPTION OF THE DRAWINGS

Certain embodiments of the invention will hereafter be described with reference to the accompanying drawings, wherein like reference numerals denote like elements, and.

DETAILED DESCRIPTION

Figure 1:
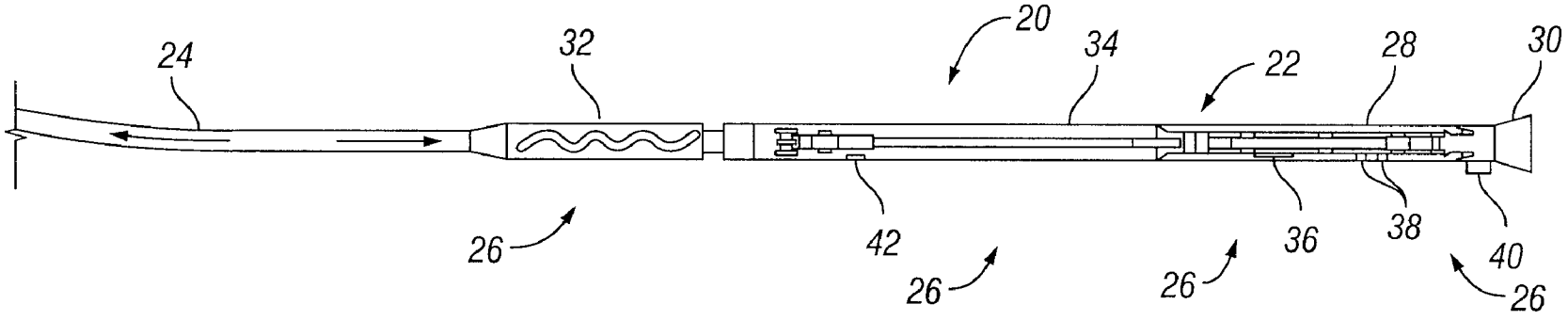
FIG. 1 is a schematic view of a drilling assembly on coiled tubing, according to an embodiment of the present invention.

In the following description, numerous details are set forth to provide an understanding of the present invention. However, it will be understood by those of ordinary skill in the art that the present invention may be practiced without these details and that numerous variations or modifications from the described embodiments may be possible.

The present invention relates to a system and methodology for coiled tubing drilling. A bottom hole assembly used as a coiled tubing drilling assembly is controllable to enable formation of wellbores along a number of selected trajectories. The bottom hole assembly can comprise steerable systems of a variety of sizes and configurations, ranging from ultra-slim steerable systems to coiled tubing drilling applications designed to drill much larger boreholes. Accordingly, conventional operating costs are reduced and the rig required for the coiled tubing drilling operation has a smaller footprint than conventional drilling rigs.

When the steering system, described below, is run below a mud motor in coiled tubing drilling, it enables continuous trajectory control. This results in a smoother well trajectory and reduced friction, thereby enabling better weight transfer to the bit, increased rate of production, and longer step-outs as the undulations and tortuosity are significantly reduced. Tool face control also is much improved, because the reactive torque in the coiled tubing from the mud motor is automatically compensated for by the rotary steerable system.

In embodiments described below, the steering system is a fully rotating rotary steering system. When used in coiled tubing drilling applications, the fully rotating aspects provide reduced friction and further step-out capability compared to existing systems that use non-rotating string elements, such as those found in U.S. Pat. No. 7,028,789. Furthermore, the present coiled tubing drilling system uses modular elements that can be moved, added or interchanged. For example, discreet, modular bottom hole assembly elements provide greater operational flexibility and enable a fully rotating steering system in contrast to the non-modular system described in U.S. Pat. No. 7,028,789. Modular tractor systems also may be incorporated into the coiled tubing drilling system to, for example, facilitate system movement and further enhance step-out capability.

The rotary steerable system also comprises processing capability sufficient to enable it to receive data from sensors, such as near-bit sensors, and to transmit that data to a surface system. The processing capability also can be used to control the steerable system from below the mud motor. Although the transfer of data to the surface collection location can be delayed, the embodiments described herein can readily provide a real-time communication of data from the rotary steerable system and its near-bit sensors to the surface location. This, of course, enables real-time monitoring of the drilling operation.

It should be noted that embodiments of the present invention can incorporate full rotation of all elements in the rotary steerable system. Furthermore, this rotatable system can either be a push-the-bit or a point-the-bit type system. Also, it should be understood the term "mud motor" can designate a variety of mud motor types, such as positive displacement or turbine type drilling motors.

One embodiment of a coiled tubing drilling system 20 is illustrated in FIG. 1. In this embodiment, coiled tubing drilling system 20 comprises a bottom hole assembly 22 in the form of a drilling assembly delivered by a coiled tubing 24. The bottom hole assembly 22 comprises a plurality of distinct and separable modules 26 that can be connected and disconnected as desired to interchange components, incorporate additional components, or otherwise change the configuration of drilling assembly 22. The modules 26 can be connected by a variety of fastening techniques including threaded engagement, use of separate threaded fasteners, or use of other suitable fastening mechanisms.

In the embodiment illustrated in FIG. 1, modules 26 of bottom hole assembly 22 comprise a steerable system 28, which in this embodiment is a rotary steerable system. The rotary steerable system 28 is a fully rotating system and is coupled to a drill bit 30. A motor 32, e.g. a mud motor, drives the rotation of rotary steerable system 28 and drill bit 30 and is coupled to coiled tubing 24. Additional modules 26 can be connected above or below motor 32. For example, a measurement-while-drilling system 34 is illustrated as a modular unit coupled between mud motor 32 and steerable system 28.

Steerable system 28 comprises data processing capability via a controller/processor 36 that receives data from steerable system sensors 38. Steerable system 28 may also include a pad/actuator to push the bit 30. The data collected from the sensors is transmitted uphole to, for example, a surface location for further analysis. Similarly, the measurement-while-drilling system also transfers data uphole. The data transfer uphole to the surface location or downhole can be accomplished through a variety of telemetry techniques, including mud-pulse telemetry, electromagnetic (E-mag) telemetry, wire-line telemetry, fiber optic telemetry, or through other communications systems and techniques. By way of example, the measurement-while-drilling system 34 located below motor 32 may utilize mud-pulse communication that relies on relatively long wavelengths. A passive power source 42, such as a battery, can be incorporated into the measurement-while-drilling system to enable a survey while the mud pumps and motor are shut off so that the measurement-while-drilling system sensors are stationary. In this example, the communications to surface from steerable system 28 are in real-time via measurement-while-drilling system 34. It should be further noted that processor 36 also can be used to control operation of steerable system 28 from a location below mud motor 32.

Figure 2:
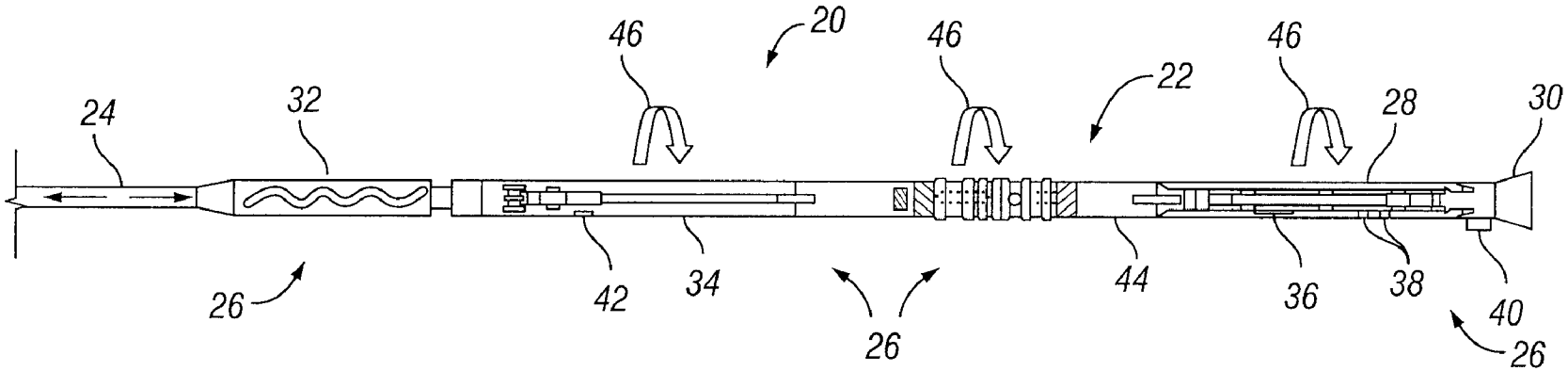
FIG. 2 is a schematic view of another embodiment of the drilling assembly on coiled tubing, according to an alternate embodiment of the present invention.

Another embodiment of coiled tubing drilling system 20 is illustrated in FIG. 2 in which an additional module 26 is mounted between motor 32 and steerable system 28. In this embodiment, a logging-while-drilling system module 44 is added intermediate steerable system 28 and motor 32. By way of example, measurement-while-drilling system 34 and logging-while-drilling system 44 may be sequentially located below motor 32 and intermediate motor 32 and steerable system 28. As with the embodiment illustrated in FIG. 1, placement of the logging-while-drilling system 44 and measurement-while-drilling system 34 below motor 32 can limit the rate at which data is transferred to the surface. However, alternative telemetry approaches, e.g. E-mag, fiber optics, and other technologies, can be utilized for the data transfer.

In the embodiments illustrated in FIGS. 1 and 2, steerable system 28 comprises a fully rotating system. However, other modules 26 located below motor 32 also can be fully rotating modules. For example, measurement-while-drilling system 34 or the combination of measurement-while-drilling system 34 and logging-while-drilling system 44 can be fully rotating systems as illustrated by arrows 46. The one or more fully rotating modules provide reduced friction and added step-out capability during coiled tubing drilling operations. Further, this approach may provide the ability to acquire rotational or azimuthal measurements and images from the LWD system 44.

Figure 3:
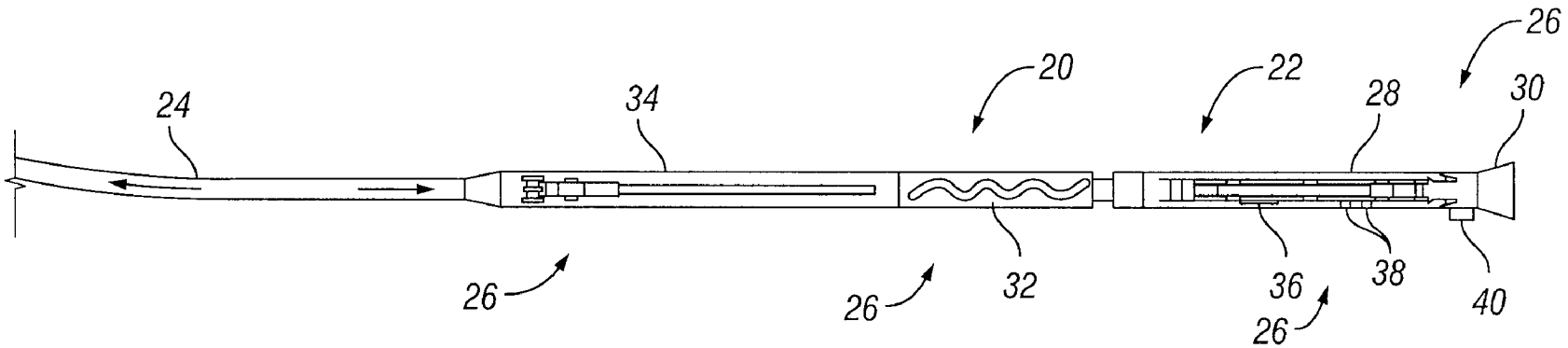
FIG. 3 is a schematic view of another embodiment of the drilling assembly on coiled tubing, according to an alternate embodiment of the present invention.

As illustrated in FIG. 3, one or more modules 26 also can be located above motor 32. In the embodiment illustrated, measurement-while-drilling system 34 is located uphole from, i.e. above, mud motor 32. In the embodiment of FIG. 3, the measurement-while-drilling system 34 slides with coiled tubing 24 but does not rotate. Placement of the measurement-while-drilling system 34 above motor 32 facilitates higher data transfer rates between system 34 and the surface. Additionally, measurement-while-drilling system 34 can be used for a survey while the mud pumps and motor 32 are operating. As illustrated, steerable system 28 remains fully rotatable and is located directly below motor 32.

Figure 4:
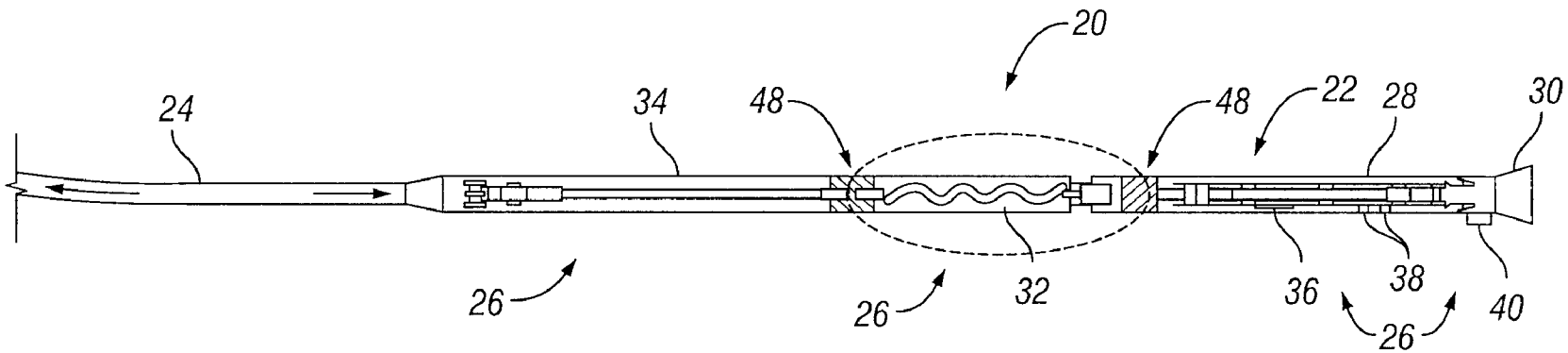
FIG. 4 is a schematic view of another embodiment of the drilling assembly on coiled tubing, according to an alternate embodiment of the present invention.

When measurement-while-drilling system 34 is located above motor 32, the communication of data, particularly real-time data, from steerable system 28 requires transfer of data across mud motor 32. For example, data from steerable system 28 can be communicated to measurement-while-drilling system 34 for transmission to the surface via a suitable telemetry method, such as those discussed above. A variety of telemetry systems potentially can be utilized to transfer data across the mud motor. However, one embodiment utilizes a plurality of transceivers 48, such as wireless receiver/transmitters, as illustrated in FIG. 4. In this latter embodiment, one wireless transceiver 48 is positioned at each end of motor 32. The communication of data from and to steerable system 28 can be conducted via E-mag wireless data communication telemetry between the transceivers 48 positioned above and below motor 32. The wireless system is a flexible system that enables placement of additional modules and other devices between the transceivers 48 without affecting real-time communications between steering system 28 and the surface. However, the data can be communicated via other telemetry methods, including other wireless methods, wired inductive methods, ultrasonic methods, and other suitable telemetry methods.

Figure 5:
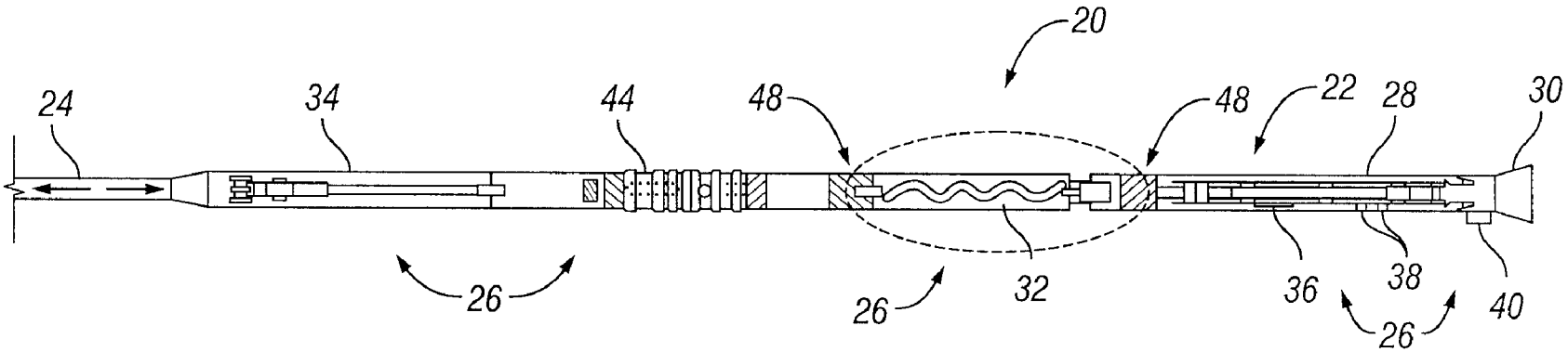
FIG. 5 is a schematic view of another embodiment of the drilling assembly on coiled tubing, according to an alternate embodiment of the present invention.

As illustrated in FIG. 5, logging-while-drilling system 44 also can be located above motor 32. Logging-while-drilling system 44 can be located above motor 32 individually or in combination with measurement-while-drilling system 34. In the illustrated example, both the measurement-while-drilling system 34 and the logging-while-drilling system 44 slide with coiled tubing 24 but do not rotate. Communication between these interchangeable modules can be accomplished by suitable telemetry methods, such as those discussed above. Furthermore, communication between steering system 28 and measurement-while-drilling system 34 and/or logging-while-drilling system 44 can be achieved through wired or wireless methods, as discussed in the preceding paragraph.

Figure 6:
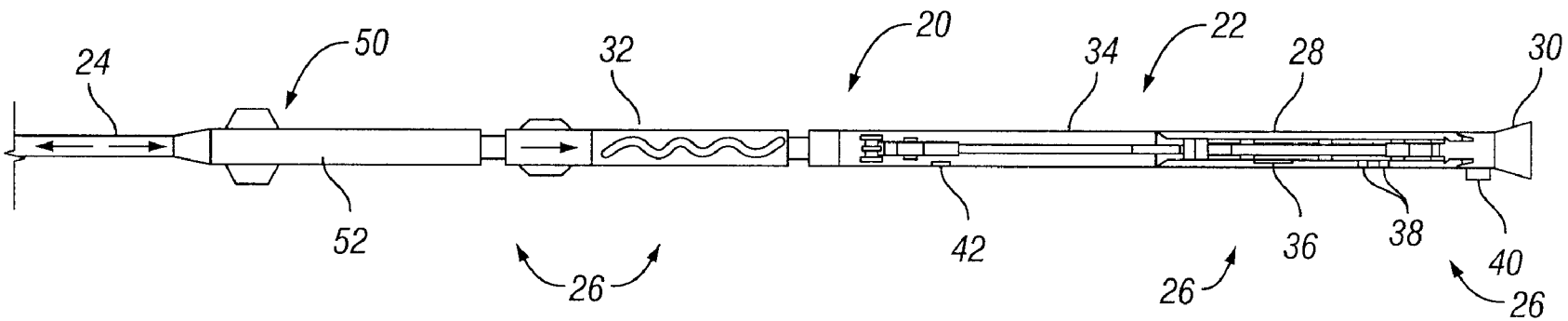
FIG. 6 is a schematic view of another embodiment of the drilling assembly on coiled tubing, according to an alternate embodiment of the present invention.

Modules 26 also may comprise an axial movement module in the form of an axial device 50, e.g. a tractor system, a thruster, a crawler, or other suitable device, connected between coiled tubing 24 and mud motor 32, as illustrated in FIG. 6. In FIG. 6, a tractor system 52 is illustrated and positioned to help overcome sliding friction associated with coiled tubing 24. The use of tractor system 52 also enhances weight transfer to drill bit 30 which increases step-out distances. Tractor system 52 can be used with any of the embodiments described herein. For example, tractor system 52 can be connected above motor 32 and measurement-while-drilling system 34 can be connected between steerable system 28 and motor 32, as illustrated in the specific example of FIG. 6.

Figure 7:
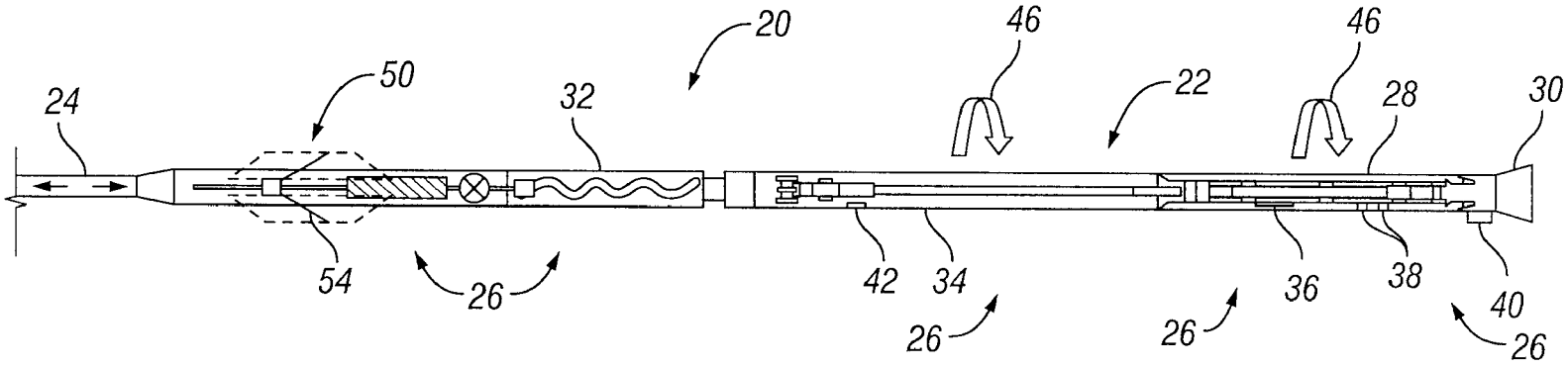
FIG. 7 is a schematic view of another embodiment of the drilling assembly on coiled tubing, according to an alternate embodiment of the present invention.

Axial device 50 also may comprise a continuous-type tractor system 54, as illustrated in FIG. 7. This type of tractor is able to provide continuous motion and can be designed to scavenge power from mud motor 32. For example, continuous-type tractor system 54 may comprise a flow conduit and track carriages that are extended by the differential pressure of flow while the forward motion is powered from the mud motor 32. This type of tractor system also can be used with any of the embodiments described above. By way of example, tractor system 54 is deployed above mud motor 32, and fully rotational steerable system 28 and measurement-while-drilling system 34 are deployed below motor 32.

Figure 8:
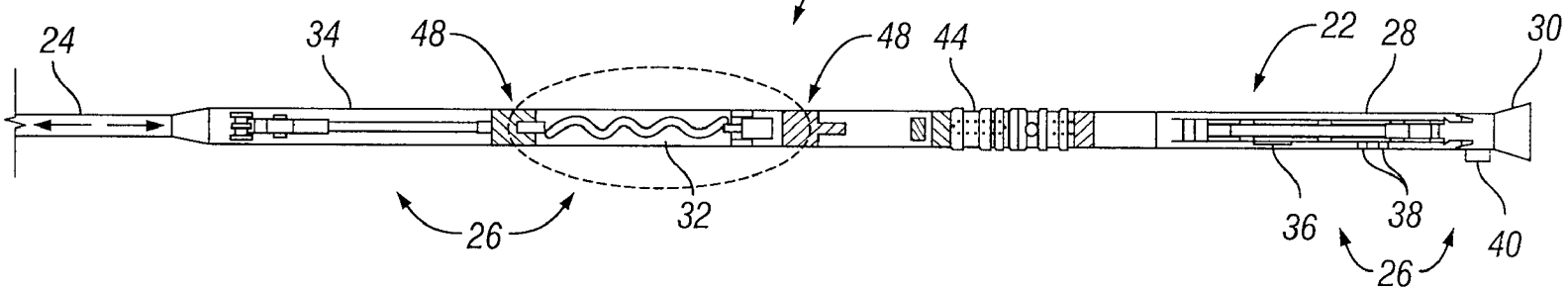
FIG. 8 is a schematic view of yet another embodiment of the drilling assembly on coiled tubing, according to another alternate embodiment of the present invention.

In another embodiment of the invention, illustrated in FIG. 8, modules 26 also may comprise an logging-while-drilling system 44 below motor 32 for the rotational or azimuthal measurements/images, a measurement-while-drilling system 34 above motor 32 and below coiled tubing 24, as well as alternate communications means through/around motor 32 (i.e. non-mud pulse) for high data rate communications.

Depending on the specific drilling operation, coiled tubing drilling system 20 may be constructed in a variety of configurations. Additionally, the use of modular components, provides great adaptability and flexibility in constructing the appropriate bottom hole assembly for a given environment and drilling operation. The actual size and construction of individual modules can be adjusted as needed or desired to facilitate specific types of drilling operations. The size of the coiled tubing also may vary depending on the environment and the desired wellbore to be drilled.

Accordingly, although only a few embodiments of the present invention have been described in detail above, those of ordinary skill in the art will readily appreciate that many modifications are possible without materially departing from the teachings of this invention. Accordingly, such modifications are intended to be included within the scope of this invention as defined in the claims.

What is claimed is:

1. A wellbore drilling system, comprising:

a coiled tubing;

a bottom hole assembly delivered downhole on the coiled tubing, the bottom hole assembly comprising a drill bit, a rotary steerable system to steer the drill bit, and a motor to drive the steerable system and the drill bit, wherein the rotary steerable system has data processing capability and further wherein the steerable system in its entirety is fully rotatable with the drill bit and is rotatable at the same rate as the drill bit during drilling of a deviated wellbore section.

2. The wellbore drilling system as recited in claim 1, further comprising a plurality of separable modules having a measurement-while-drilling system positioned between the motor and the steerable system.

3. The wellbore drilling system as recited in claim 2, further comprising a plurality of separable modules having a logging-while-drilling system positioned between the motor and the steerable system.

4. The wellbore drilling system as recited in claim 1, further comprising a plurality of separable modules having a measurement-while-drilling system positioned uphole of and not rotatable with the motor.

5. The wellbore drilling system as recited in claim 1, further comprising a plurality of separable modules having a logging-while-drilling system positioned between the motor and the steerable system.

6. The wellbore drilling system as recited in claim 5, wherein the logging-while-drilling system is used to acquire rotational and azimuthal measurements.

7. The wellbore drilling system as recited in claim 1, further comprising a plurality of separable modules having a reciprocating-type tractor system positioned uphole of and not rotatable with the motor.

8. The wellbore drilling system as recited in claim 1, further comprising a plurality of separable modules having a continuous-type tractor system positioned uphole of and not rotatable with the motor.

9. The wellbore drilling system as recited in claim 1, further comprising a plurality of separable modules having a pair of wireless transceivers with one transceiver on each end of the motor.

10. The wellbore drilling system as recited in claim 1, wherein the rotary steering system comprises data processing capability with a controller receiving data from at least one rotary steerable system sensor.

11. A method, comprising:

arranging a steering system, a drill bit, and a motor on an end of coiled tubing, the steering system positioned between the drill bit and the motor, wherein the steering system comprises at least one sensor and data processing capability; and delivering the steering system, the drill bit and the motor downhole on the coiled tubing;

rotating the steering system in its entirety via the motor during drilling of a deviated wellbore section;

transmitting data received from the sensors and processed by the steering system to a surface system; and utilizing data processed by the steering system to enable control over the steering system from below the motor.

12. The method as recited in claim 11, further comprising adding additional modular components between the motor and the steering system.

13. The method as recited in claim 12, wherein adding comprises adding a measurement-while-drilling system between the motor and a steering system.

14. The method as recited in claim 13, wherein adding comprises adding a logging-while-drilling system between the motor and the steering system.

15. The method as recited in claim 11, further comprising adding a measurement-while-drilling system above the motor, and directing communications between the measurement-while-drilling system and the steering system.

16. The method as recited in claim 11, wherein delivering comprises using a tractor.

17. A system for drilling comprising:

coiled tubing extendable into a wellbore;

a drill bit positioned at one end of the coiled tubing for forming the wellbore;

a rotary steering system connected to the coiled tubing and having data processing capability for steering the drill bit; and a motor connected to the coiled tubing such that the rotary steering system is positioned between the drill bit and the motor, the motor having an output shaft for rotating the rotary steering system in its entirety and the drill bit during drilling of a deviated wellbore section.

18. The system of claim 17 further comprising a measurement-while-drilling tool positioned between the motor and the drill bit, wherein the measurement-while-drill tool transmits data related to a formation about the wellbore to the Earth's surface.

19. The system of claim 18 wherein the measurement-while-drilling tool is rotatable with the steering system and the drill bit.

* * * * *

UNITED STATES PATENT AND TRADEMARK OFFICE

CERTIFICATE OF CORRECTION

PATENT NO. : 8,408,333 B2
APPLICATION NO. : 11/740335
DATED : April 2, 2013
INVENTOR(S) : Satish Pai It is certified that error appears in the above-identified patent and that said Letters Patent is hereby corrected as shown below:

On the Title Page, Item (54) and in the Specification, Column 1, line 1, Title should be corrected as follows.

-- Steering Systems For Coiled Tubing Drilling and Method of Use --

Signed and Sealed this
First Day of July, 2014

Michelle K. Lee

Michelle K. Lee
*Deputy Director of the United States Patent and Trademark Office*